United States Patent [19]

Alkasab

[11] 4,007,776

[45] Feb. 15, 1977

[54] HEATING AND COOLING SYSTEM UTILIZING SOLAR ENERGY

[75] Inventor: Kalil A. Alkasab, Wheaton, Ill.

[73] Assignee: Universal Oil Products Company, Des Plaines, Ill.

[22] Filed: Dec. 23, 1974

[21] Appl. No.: 535,252

[52] U.S. Cl. ..... 165/18; 62/2; 62/500; 165/DIG. 15; 165/63; 237/1 A

[51] Int. Cl.[2] ..... F24D 11/00; F25B 29/00; F25B 27/00

[58] Field of Search ..... 62/2, 500; 165/63, 48, 165/18, 65, 104, 106, DIG. 15

[56] References Cited

UNITED STATES PATENTS

| | | | |
|---|---|---|---|
| 2,030,350 | 2/1936 | Bremser | 62/2 |
| 2,183,821 | 12/1939 | Nelson | 62/500 X |
| 2,257,983 | 10/1941 | Shipman | 62/500 X |
| 2,396,338 | 3/1946 | Newton | 62/2 X |
| 2,693,939 | 11/1954 | Merchant et al. | 62/2 X |
| 2,713,252 | 7/1955 | Jackson et al. | 62/2 X |
| 3,236,294 | 2/1966 | Thomason | 165/63 X |
| 3,242,679 | 3/1966 | Puckett et al. | 62/2 |
| 3,500,897 | 3/1970 | Von Gube | 62/500 |
| 3,590,910 | 7/1971 | Lorenz | 165/48 X |
| 3,894,528 | 7/1975 | Stubblefield | 62/6 X |

*Primary Examiner*—Charles J. Myhre
*Assistant Examiner*—Ira S. Lazarus
*Attorney, Agent, or Firm*—James R. Hoatson, Jr.; Barry L. Clark; William H. Page, II

[57] ABSTRACT

System using solar energy to heat a fluid in a heat storage tank can be utilized in either a heating mode or cooling mode. In the heating mode, several valves are actuated to cause fluid contained in an internal heat exchanger in the heat storage tank to circulate in series circuit with external heat exchange means in communication with the space to be heated. In the cooling mode, the valves are operated to cause the heated fluid in the internal heat exchanger mounted in the heat storage tank to circulate to a heat exchanger mounted in a refrigerant boiler. As the refrigerant boils, vapors are formed which pass through an ejector. The expanded refrigerant vapors are then condensed to liquid in a fan cooled condenser and a portion of the liquid is returned to the refrigerant boiler by a refrigerant circulating pump. The remaining portion of the refrigerant liquid leaving the condenser is delivered to an evaporator which is located in heat exchange relationship with brine or other cooled liquid in a cold storage tank. The surface of the refrigerant in the evaporator is in communication with the ejector. Cooling of the evaporator refrigerant takes place as a result of its vapor pressure being lowered by the vacuum produced in the ejector by the expansion of the vapors from the boiler as they pass through it. The lowered vapor pressure of the refrigerant liquid in the evaporator causes it to boil at a lower temperature, thereby drawing heat from the brine. A heat exchanger in the cold storage tank is connected in series circuit with the external heat exchange means in the space to be cooled.

3 Claims, 2 Drawing Figures

HEATING AND COOLING SYSTEM UTILIZING SOLAR ENERGY

BACKGROUND OF THE INVENTION

The invention relates to the use of solar energy to heat and or cool an enclosed space such as a residence. Although there are many prior art systems which use solar energy to heat water in a storage tank and then directly or indirectly circulate the heated water to heat exchangers, there are very few systems which attempt to cool as well. Examples of solar energy powered cooling systems include: the compressor type system shown in U.S. Pat. No. 2,693,939 wherein heat is transferred to the earth; the system of U.S. Pat. No. 2,396,338 wherein a cold storage means is cooled by radiating heat to the universe at night; and the ejection type system of U.S. Pat. No. 3,242,679 wherein a pair of solar powered gas generators are alternately heated and cooled by surrounding water jackets in expansion and refill cycles, respectively.

With the peak in electrical power consumption having switched from winter to summer in recent years the advantages of a cooling system using solar energy are especially attractive. Since the summer hours of peak electrical demand will be those when the sun is brightest, a cooling system using solar energy will require less anxiliary electrical power when the demand by others is greatest.

SUMMARY

It is among the objects of the present invention to provide a solar energy powered heating and cooling system which is simple in design, which is easily switched from a heating to a cooling mode, which produces cooling from the relatively low temperature water supplied from a flat plate solar collector and which provides storage capacity for both heat and cold and uses both for cooling to limit the requirement for auxiliary power.

These and other objects are attained by the system of the present invention which includes a number of fluid circulating circuits to provide heating and cooling. In the system, solar energy is collected by a collector device such as a simple flat plate collector mounted on the roof of a residence. A collector circuit circulates water or other fluid from a heat storage tank through the solar collector by means of a collector pump. After the water is heated by the solar collector it is returned to the heat storage tank to raise the temperature thereof. Temperature sensors in the heat storage tank and within the solar collector sense the fluid temperature and the temperature of the absorption surface of the collector and are utilized in a control device to prevent the collector pump from operating when the water in the storage tank is hotter than the absorption surface in the solar collector. In order to insure sufficient hot water in the storage tank when there are long periods without sunshine, an auxiliary heating element is provided in the heat storage tank. The auxiliary heater is preferably electrical but could also be oil or gas powered. It is preferably thermostatically controlled to maintain the water in the heat storage tank at a minimum temperature.

A heat exchanger located within the heat storage tank has inlet and outlet tubes which carry circulating water which is heated indirectly by the fluid in the tank. Depending on whether the system is in its heating mode or its cooling mode, a set of 3-way valves is selectively actuated to direct the water to either heat exchange means for warming the space to be heated or to a refrigerant boiler. In the heating mode, the house thermostat can control the pump which circulates the water to the heat exchange means. The space heating and cooling heat exchange means can be located centrally and connected to a central blower and air ducts or can be located in individual rooms. If desired, separate heat exchangers could be used for heating and cooling.

When the 3-way valves are actuated in the cooling mode, the heat storage tank heat exchanger is directly coupled with a heat exchanger in a refrigerant boiler to circulate heated water from the heat storage tank to the boiler so as to heat the refrigerant therein. Preferably, a refrigerant having a relatively low boiling point is used since flat plate solar collectors have a relatively limited heating capacity. Refrigerant R-11, which evaporates at 75° F at atmospheric pressure, is an example of a suitable refrigerant. As the refrigerant boils, the vapors formed in the boiler travel to an ejector where they expand and produce a vacuum which lowers the boiling point of liquid refrigerant in an evaporator and draws additional refrigerant vapors from the evaporator into the ejector. The combined vapors or gases then pass to a fan cooled condenser where they are cooled and condensed into liquid. A refrigerant pump in the refrigerant circuit pumps a portion of the refrigerant liquid back to the boiler and a portion back to the evaporator. The evaporator is positioned in a cold storage tank in heat exchange relation with a quantity of brine therein. The evaporator serves to cool the brine by drawing heat from it to replace heat lost by the refrigerant as it boils in response to the lowering of its vapor pressure by the vacuum in the ejector.

A heat exchanger in the cold storage tank is placed in series with the heat exchange means in the space being cooled to circulate cold water to it as an incident of operating the aforementioned 3-way valves. The circulating pump is controlled by the house thermostat. To prevent freezing of either the brine in the cold storage tank of the circulating water, a temperature sensor is placed in the brine and used to control the operation of the refrigerant pump, the condenser fan, and the boiler pump which circulates hot water to the boiler from the heat storage tank.

The heating and cooling system disclosed broadly herein appears to provide cooling in a very simple and efficient manner and with a minimal requirement for equipment. Heat balance calculations indicate that a collector area of about 480 square feet, a heat storage tank having a capacity of about 1200 gallons, a cold storage tank containing 2000 gallons of 10% brine, a boiler temperature of 170° F, a heat storage tank temperature of 190° F, a condenser outlet temperature of 80° F, an evaporator temperature of 50° F, and a brine temperature of 35° F will provide a coefficient of performance using Refrigerant R-11 of 0.77 and will provide 36,000 BTU/hour cooling capacity when operated 20% of an average summer day in Madison, Wisconsin. The system will also have storage capacity of 50% of the above loading. If more collector area is provided the boiler temperature could go down to about 140° F.

DESCRIPTION OF THE PREFERRED EMBODIMENT

Figure 1:
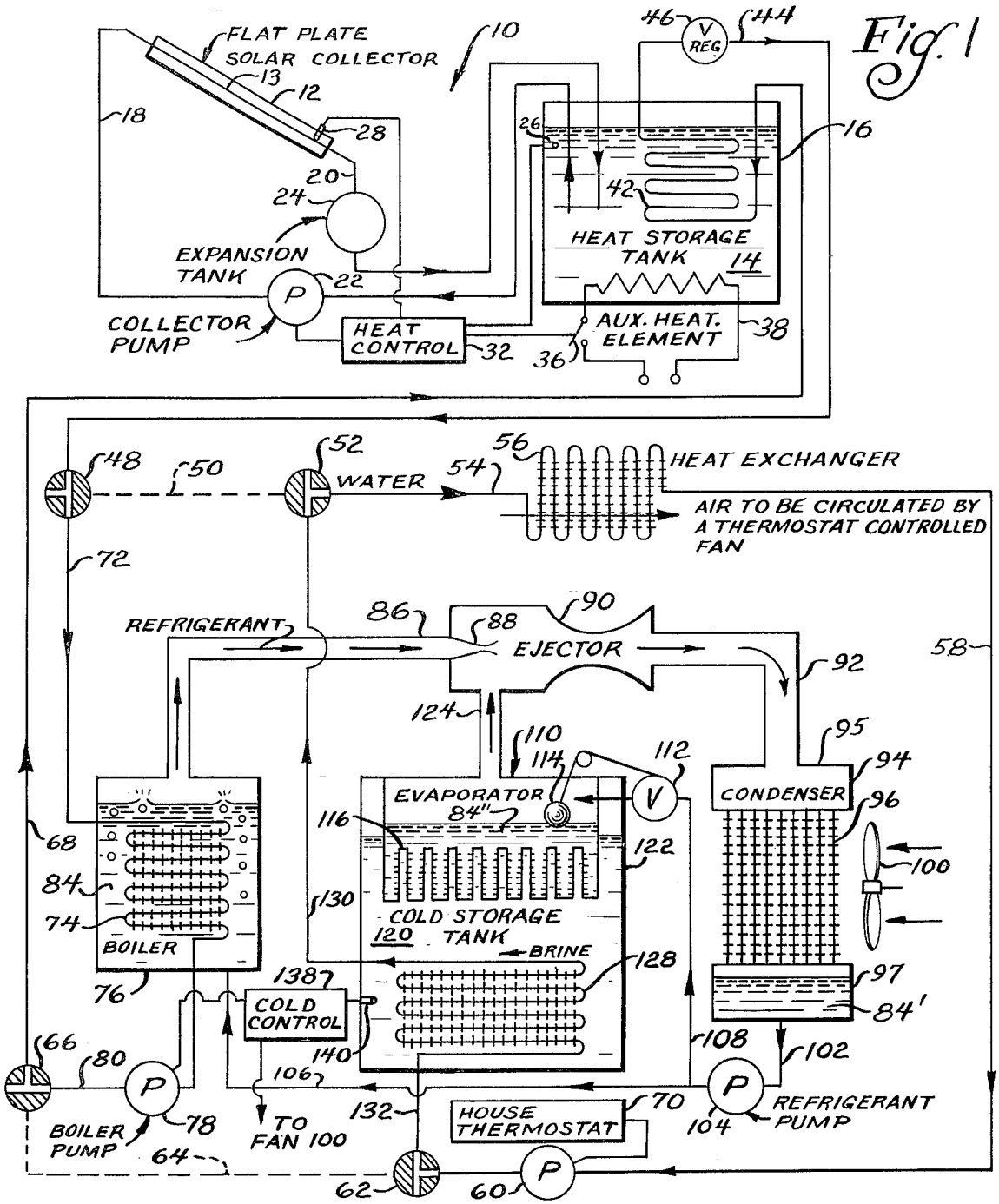
FIG. 1 is a schematic circuit diagram of the heating and cooling system with those portions of the circuit which are used only in the heating mode, and not required in the cooling mode, being shown in dotted lines.

Referring to FIG. 1, my improved heating and cooling system is indicated generally at 10 and includes a solar collector 12 which has an absorption surface 13 from which heat may be collected by water 14 which is circulated to the solar collector from the heat storage tank 16 by means of an inlet circulating line 18 and an outlet circulating line 20. The flow of water 14, or any other heat transfer fluid, is caused by circulating pump 22 positioned in the inlet line 18. Preferably, an expansion tank 24 is located in the outlet line 20. It is desirable to prevent the circulation of water through the solar collector 12 when the water leaving the collector 12 would not be as hot as the water already in the storage tank 16. For this purpose, a water temperature sensor 26 is located in the heat storage tank 16 and a collector temperature sensor 28 is located in contact with absorption surface 13. The temperature readings produced by the aforementioned sensors 26, 28 are compared in a heat controller 32 in a conventional manner and used to control the operation of circulating pump 22. When the temperature of the water 14 in the storage tank 16 is less than a predetermined minimum, such as 150° F, a heater switch 36 operated by the heat control unit 32 is actuated to energize auxiliary heating element 38 located in the heat storage tank 16. In order to minimize the operation of the auxiliary heating element the swtich 36 is preferably de-energized by the controller 32 when the water 14 in tank 16 reaches a temperature of approximately 160° F.

Figure 2:
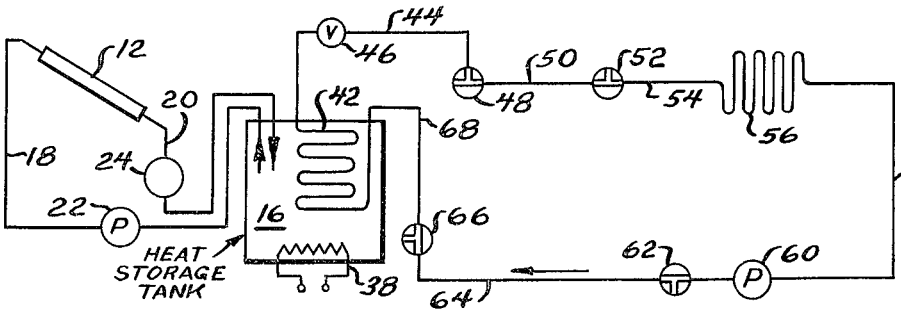
FIG. 2 is a schematic circuit diagram showing only those portions of the system used for the heating mode with the portions of the system used only for cooling being deleted for clarity.

Located within the heat storage tank 16 is a heat exchange coil 42 having an outlet line 44 which contains a flow regulating valve 46 for controlling the rate of flow in the line 44 and thus the rate at which heat can be transferred from the water 14 in storage tank 16. When the system 10 is to be used for heating (FIG. 2), the fluid in line 44, which may be water or other suitable heat transfer medium, passes through 3-way valve 48 which is actuated in the heating mode to the position shown in FIG. 2 to direct the fluid through line 50 to a second 3-way valve 52 from whence it flows through line 54 and through a heat exchanger 56. The heat exchanger 56 preferably has air passed through it by a circulating fan (not shown) for warming the space to be heated and may be either a central type unit such as found in conventional heating and air conditioning systems or an individual room unit. After losing heat in the heat exchanger 56, the cooled fluid flows through line 58, heat exchanger circulating pump 60, 3-way valve 62, line 64, 3-way valve 66 and back through line 68 to the heat exchange coil 42 in the heat storage tank 16 to be reheated. A thermostat 70 controls the operation of circulating pump 60 to control the amount of heat available to the heat exchanger 56.

In the cooling mode (FIG. 1) the 3-way valve 48 is actuated to the position shown in FIG. 1 so that the hot fluid in line 44 will pass through line 72 into a heat exchange coil 74 positioned within the refrigerant boiler 76. As the cooled fluid exits from the heat exchanger 74 it passes through boiler pump 78, line 80, 3-way valve 66 and back through return line 68 to the heat exchange coil 42. The refrigerant boiler 76 contains a refrigerant 84 such as refrigerant R-11 which boils at atmospheric pressure at approximately 75° F. As the refrigerant 84 is boiled in boiler 76 by the heat produced by heat exchange coil 74 the vapors produced pass through ejector inlet tube 86 and through nozzle 88 in the ejector 90. As the vapors or gases leave the nozzle 88 their pressure is greatly reduced so as to create a vacuum condition within the ejector 90. The gases then leave the ejector through an ejector outlet tube 92 from whence they pass to a condenser 94 having an inlet gas manifold 95, heat exchange tubes 96 and an outlet gas manifold 97. The gases entering the inlet manifold 95 are cooled as they pass through the heat exchange tubes 96 by a fan 100 and are condensed into liquid 84' by the time they reach the outlet manifold 97. The condensed liquid then passes through liquid line 102 and refrigerant pump 104. A portion 84 of the liquid is then returned through boiler refrigerant inlet line 106 to the boiler 76. The remaining portion 84'' of the liquid condensate leaving the condenser 94 passes through the evaporator refrigerant inlet line 108 into the evaporator indicated generally at 110. The flow of liquid into the evaporator 110 is controlled by valve 112 in response to the liquid level of fluid 84'' as sensed by float member 114. The evaporator 110 includes a plurality of evaporator heat exchange tubes 116 which contact the refrigerant liquid 84'' on their external surfaces while contacting the brine solution 120 with their internal surfaces. The brine solution 120 is contained in a large cold storage tank 122. A suction line 124 connects the evaporator 110 to the vacuum region of ejector 90 produced by the venturi effect of the nozzle 88. Accordingly, the surface of the liquid 84'' in the evaporator 110 is subjected to a much lower surface pressure than the liquid 84 in the boiler 76. The lower pressure reduces the boiling point of the liquid 84'' in the evaporator and thereby cools the liquid 84'' as heat is extracted from it to boil off vapors which are drawn into ejector 90. The brine 120 is also cooled as heat is extracted from it by the heat exchange tubes 116 to replace the heat removed from the refrigerant 84''.

The cold stored in the storage tank 22 is transmitted to the residence heat exchange means 56 by a heat exchange coil 128 filled with water or other suitable heat exchange fluid positioned in the brine, outlet line 130, 3-way valve 52 and line 54. The warmed fluid is returned to tank 122 by line 58, pump 60, 3-way valve 62 and return line 132. The flow of cold fluid through the heat exchanger 56 is controlled by the residence thermostat 70 which is connected to the circulating pump 60. In order to prevent the cold storage tank 122 from getting too cold and freezing up, a cold control 138 is provided which includes a temperature sensor 140 immersed in the brine 120. When the brine 120 drops to a temperature of approximately 35° F the cold control 138 turns off the boiler pump 78, the refrigerant circulating pump 104 and the condenser cooling fan 100.

From the preceding description it will be readily evident that the disclosed system provides great storage capacity for cooling in the summer months when electrical demand is highest by storing both heat in tank 76 and cold in tank 122. Although not specifically described, it is obvious that the cold storage tank 122 could be connected to the heat storage tank 76 to provide additional heat storage capacity in the winter. Preferably, the cold storage tank 122 has greater capacity than the heat storage tank 76 since its operating temperature of about 35° F is much closer to ambient temperature than is the 160° F or greater operating temperature of the fluid in the heat storage tank 76. Accordingly, the efficiency of the cold storage tank is higher since losses due to poor insulation are directly related to the temperature differences.

I claim as my invention:

1. In a solar heating and cooling system for an enclosed space, a solar energy collector and collector fluid circulating means to carry heated fluid from said solar energy collector to a heat storage tank and return cooled fluid from said tank to said collector; a closed circuit fluid circulating conduit means including a heat exchange portion within said heat storage tank and a plurality of valve members for selectively connecting said closed circuit fluid circulating conduit means in either a heating mode in direct circuit with heat exchange means for heating said enclosed space, or in a cooling mode in direct circuit with a heat exchange means for heating a refrigerant boiler which forms part of a closed refrigerant circulating system wherein refrigerant vapor produced by said refrigerant boiler is expanded in an ejector, cooled in a condenser, and used to lower the vapor pressure and temperature of refrigerant in an evaporator which is connected to the ejector, said evaporator being in heat exchange relationship with fluid in a cold storage tank, said heat exchange means for said enclosed space being in heat exchange relationship with the fluid in said cold storage tank during said cooling mode.

2. The solar heating and cooling system of claim 1 wherein said collector fluid circulating means is controlled by temperature responsive means so as to be operative only when the temperature of fluid leaving the solar collector would be higher than the temperature of the fluid in said heat storage tank, and auxiliary heating means in said heat storage tank for heating said tank when insufficient heat is obtained from said solar collector.

3. The solar heating and cooling system of claim 2 wherein, when said system is in its cooling mode, means responsive to the temperature of the cooled fluid in the cold storage tank controls the operation of the refrigerant circulating system and the closed circuit fluid circulating conduit means.

* * * * *